US009453476B2

(12) United States Patent
Rumpsa

(10) Patent No.: US 9,453,476 B2
(45) **Date of Patent: *Sep. 27, 2016**

(54) METHOD FOR OPERATING A DIRECT FUEL INJECTOR

(71) Applicant: Ford Global Technologies, LLC, Dearborn, MI (US)

(72) Inventor: Todd Anthony Rumpsa, Saline, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/680,940

(22) Filed: Apr. 7, 2015

(65) Prior Publication Data

US 2015/0211432 A1 Jul. 30, 2015

Related U.S. Application Data

(63) Continuation of application No. 13/852,824, filed on Mar. 28, 2013, now Pat. No. 8,997,714.

(51) Int. Cl.

| | |
|---|---|
| ***F02D 41/30*** | (2006.01) |
| ***F02D 41/38*** | (2006.01) |
| ***F02M 63/02*** | (2006.01) |
| ***F02M 53/04*** | (2006.01) |
| ***F02D 41/04*** | (2006.01) |

(52) U.S. Cl.

CPC ..... *F02D 41/3863* (2013.01); *F02D 41/04* (2013.01); *F02D 41/3094* (2013.01); *F02M 53/043* (2013.01); *F02M 63/0265* (2013.01); *F02M 63/0275* (2013.01); *F02D 2200/0602* (2013.01); *F02D 2200/0606* (2013.01)

(58) Field of Classification Search

CPC ..... F02D 41/30; F02D 41/3094; F02D 2200/0602; F02D 2041/389; F02D 41/0007; F02D 41/3845; F02D 19/024; F02D 41/3809

USPC ..... 123/294–305, 575, 578

See application file for complete search history.

(56) References Cited

U.S. PATENT DOCUMENTS

| | | | | |
|---|---|---|---|---|
| 6,408,823 | B1 * | 6/2002 | Takahashi | F02D 41/2464 123/456 |
| 6,422,203 | B1 | 7/2002 | Djordjevic | |
| 6,494,182 | B1 | 12/2002 | Djordjevic | |
| 6,637,408 | B2 | 10/2003 | Djordjevic | |
| 7,000,600 | B1 | 2/2006 | Yamada et al. | |
| 7,021,278 | B2 | 4/2006 | Ishizuka et al. | |

(Continued)

FOREIGN PATENT DOCUMENTS

| | | | |
|---|---|---|---|
| EP | 1408223 | A1 | 4/2004 |
| EP | 1662113 | A2 | 5/2006 |
| WO | 2006092441 | A1 | 9/2006 |

*Primary Examiner* — Marguerite McMahon
*Assistant Examiner* — Tea Holbrook
(74) *Attorney, Agent, or Firm* — Julia Voutyras; Alleman Hall McCoy Russell & Tuttle LLP

(57) ABSTRACT

A method, comprising: operating an engine cylinder with fuel from a first injector and not a second injector and activating the second injector in response to a rail pressure increase of a fuel rail, the fuel rail coupled to the second injector. In this way, degradation of the second injector may be reduced by activating the second injector and allowing fuel flow through the second injector to reduce the pressure and temperature of the fuel rail.

19 Claims, 4 Drawing Sheets

(56) References Cited

U.S. PATENT DOCUMENTS 7,124,737 B2 10/2006 Sadakane et al.
7,213,574 B2 * 5/2007 Nishimura ..... F02D 41/022 123/431
7,316,219 B2 * 1/2008 Yamaguchi ..... F02D 41/042 123/304
8,118,006 B2 * 2/2012 Pursifull ..... F02D 41/0027 123/299
8,118,014 B2 * 2/2012 Lippa ..... F02D 19/0684 123/431
8,364,384 B2 * 1/2013 Pursifull ..... F02D 41/0027 123/299
2002/0096145 A1 * 7/2002 Ricco ..... F02D 41/38 123/446
2005/0224601 A1 10/2005 Baker et al.
2006/0000452 A1 * 1/2006 Tokuda ..... F02D 33/006 123/456
2006/0207565 A1 9/2006 Nishimura
2007/0186907 A1 8/2007 Otani et al.
2009/0007885 A1 1/2009 Serra et al.
2009/0188469 A1 * 7/2009 Tsukada ..... F02D 41/3863 123/456
2009/0260601 A1 * 10/2009 Ulrey ..... F02B 1/12 123/512
2010/0252004 A1 * 10/2010 Miersch-Wiemers F02D 19/0628 123/495
2010/0294236 A1 * 11/2010 Surnilla ..... F02D 41/0025 123/304
2011/0132321 A1 * 6/2011 Pursifull ..... F02D 41/0027 123/299
2011/0162620 A1 * 7/2011 Bidner ..... F02D 41/0025 123/299
2011/0297753 A1 12/2011 McAlister et al.
2012/0060793 A1 3/2012 Kim
2012/0174891 A1 7/2012 Marriott et al.
2013/0080032 A1 3/2013 Kaneko et al.
2013/0092130 A1 4/2013 Kylström
2013/0218440 A1 8/2013 Styrom

* cited by examiner

METHOD FOR OPERATING A DIRECT FUEL INJECTOR

CROSS REFERENCE TO RELATED APPLICATIONS

The present application is a continuation of U.S. patent application Ser. No. 13/852,824, entitled "METHOD FOR OPERATING A DIRECT FUEL INJECTOR," filed on Mar. 28, 2013, now U.S. Pat. No. 8,997,714, the entire contents of which are hereby incorporated by reference for all purposes.

BACKGROUND AND SUMMARY

Engines may be configured with various fuel systems used to deliver a desired amount of fuel to an engine for combustion. One type of fuel system includes a port fuel injector and a direct fuel injector for each engine cylinder. The port fuel injectors may be operated to improve fuel vaporization and reduce engine emissions, as well as to reduce pumping losses & fuel consumption at low loads. The direct fuel injectors may be operated during higher load conditions to improve engine performance and fuel consumption at higher loads. Additionally, both port fuel injectors and direct injectors may be operated together under some conditions to leverage advantages of both types of fuel delivery.

Engines operating with both port fuel injectors and direct injectors may operate for extended periods without using the direct injectors. The direct injectors may be coupled to a high-pressure fuel rail upstream of a high-pressure fuel pump. During periods of non-operation, a one-way check valve may result in high-pressure fuel being trapped in the high-pressure fuel rail. Any increase in temperature of the fuel would then result in an increased fuel pressure, due to the closed and rigid nature of the fuel rail. This increased temperature and pressure may in turn affect the durability of both the direct fuel injectors and the high-pressure fuel pump.

To reduce degradation of the direct fuel injectors and high-pressure fuel pump, a constant or periodic amount of fuel may be injected from the direct fuel injectors during operation of the vehicle. However, the inventors herein have recognized problems with such an approach. As one example, it may be desirable to run maximum sustained PFI operation for improved fuel economy and reduced emissions. In another example, the direct fuel injectors may be coupled to a limited supply of fuel, which may thus be depleted and not be available when needed if fuel is constantly injected. Further, this approach may not significantly impact component durability if fuel is injected below a threshold pressure or temperature over which the likelihood of degradation increases.

Such issues may be addressed by, in one example a method, comprising: operating an engine cylinder with fuel from a first injector and not a second injector and activating the second injector in response to a rail pressure increase of a fuel rail, the fuel rail coupled to the second injector. In this way, degradation of the second injector may be reduced by activating the second injector and allowing fuel flow through the second injector to reduce the pressure and temperature of the second fuel system components. Further, by monitoring rail pressure increases of a relative fixed-volume fuel rail, temperature changes corresponding to pressure changes can be identified so that relevant temperature information is obtained.

In another example, a fuel system for an internal combustion engine, comprising: a group of direct fuel injectors in communication with a group of cylinders, a first fuel rail in communication with the group of direct injectors, a high-pressure fuel pump in communication with the first fuel rail, and a control system configured with instructions for: during a first condition, increasing a flow of fuel through the first fuel rail when a temperature change in a fuel included in the first fuel rail exceeds a threshold, the temperature change based on a rail pressure change. In this way, if an engine is operating off a port-injection fuel system and not the direct injection fuel system, the direct injection fuel system may be activated even if not needed in order to cool the direct injection fuel system.

In yet another example, a method, comprising: operating an engine cylinder with fuel from a first injector and not a second injector, and activating a fuel pump coupled to the second injector in response to a rail pressure increase of a fuel rail, the fuel rail coupled between the second injector and the pump. In this way, fuel can be circulated through the fuel rail responsive to increases in rail pressure.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

FIG. 1 schematically depicts an example embodiment of a cylinder of an internal combustion engine.

FIG. 2 schematically depicts an example embodiment of a multi-cylinder engine.

DETAILED DESCRIPTION

Figure 1:
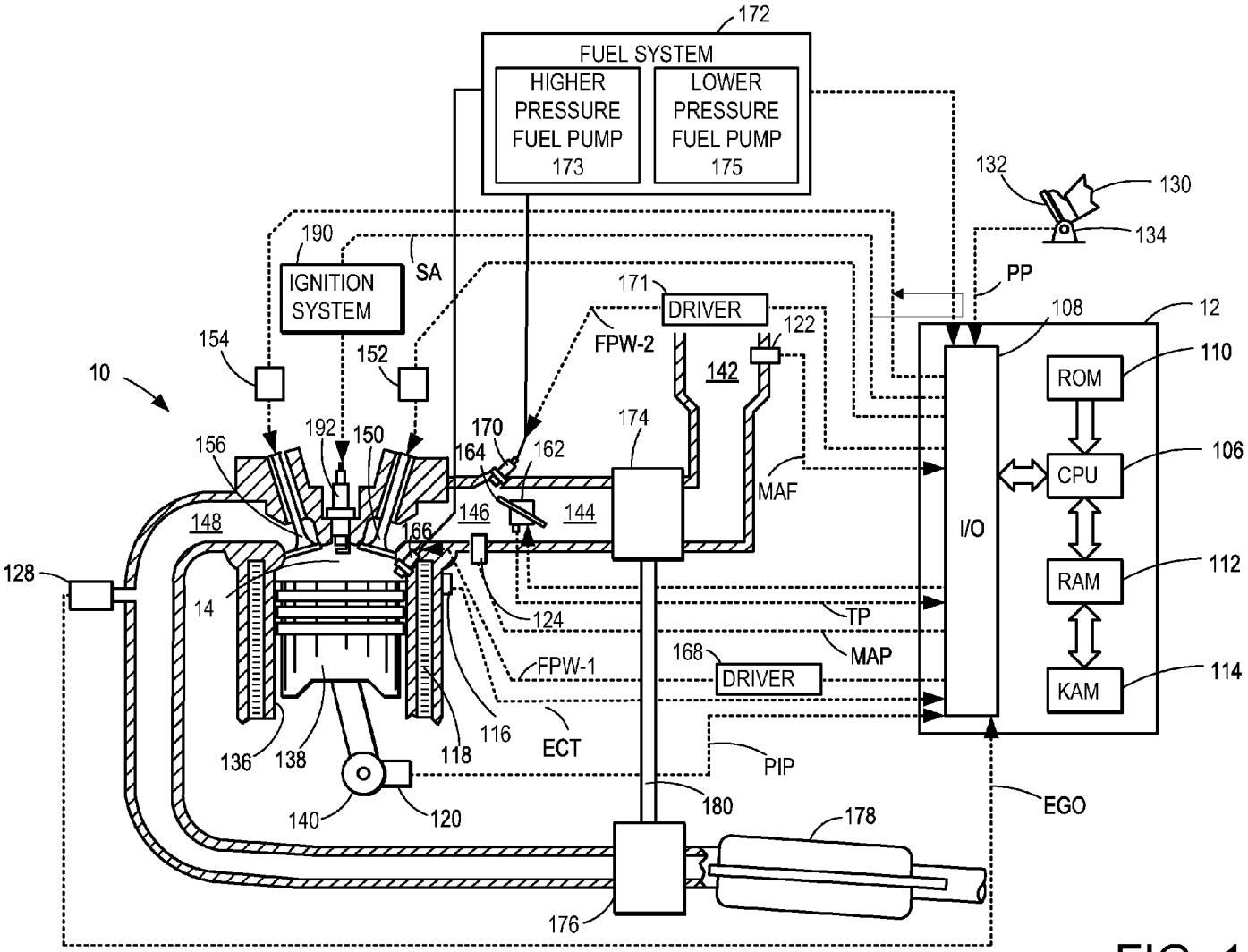
Figure 2:
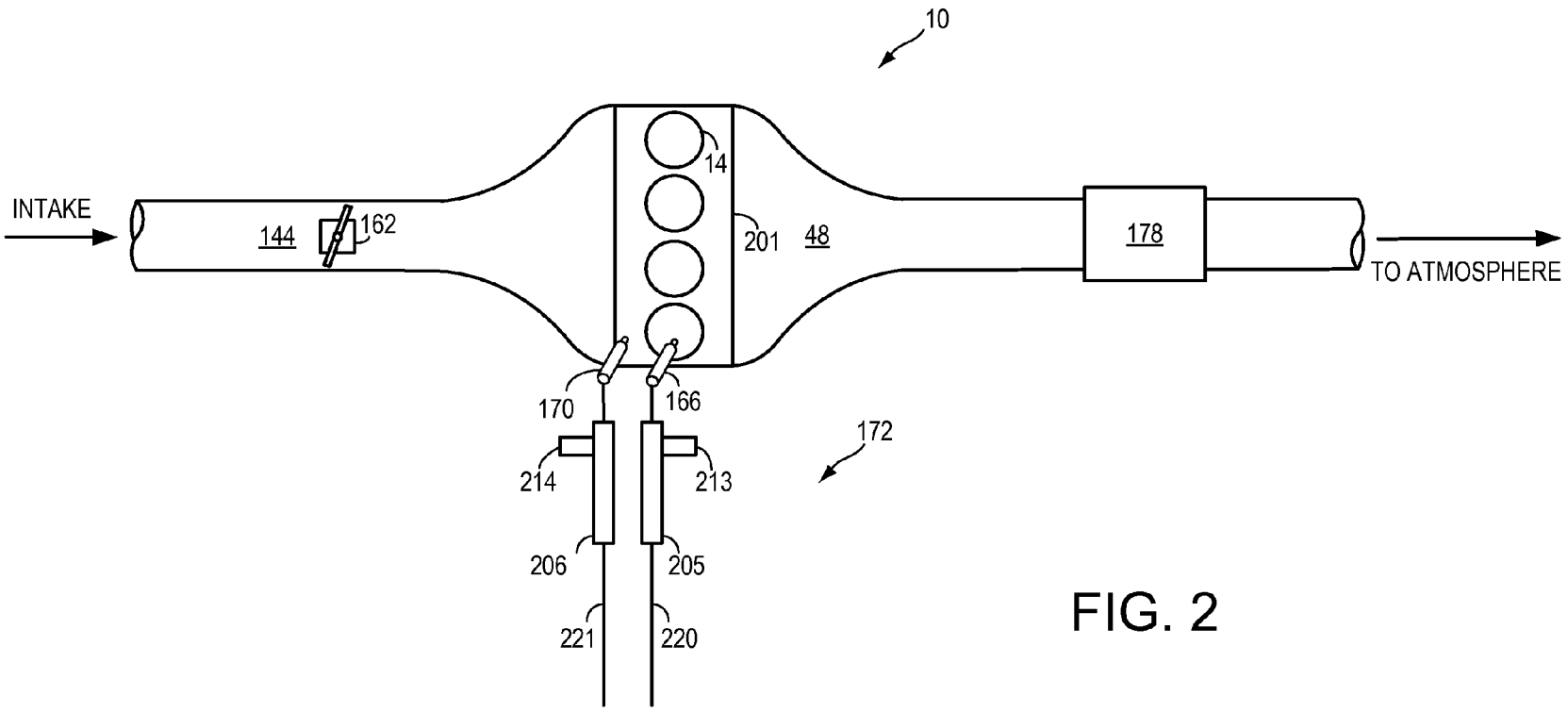

The present description relates to systems and methods for operating a direct fuel injector within an engine system where more than one fuel injectors are coupled to an engine cylinder. In one non-limiting example, the engine may be configured as illustrated in FIG. 1. Further, additional components of a fuel injection system as depicted in FIG. 2 may be included in the engine depicted in FIG. 1. A method for operating a direct fuel injector may be provided by the systems illustrated in FIGS. 1 and 2 and the method illustrated in FIG. 3, which shows an example method for operating a direct fuel injector. An example timeline for operating a direct fuel injector in accordance with the above method and systems is depicted in FIG. 4.

FIG. 1 depicts an example embodiment of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (i.e. combustion chamber) 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be disposed downstream of compressor 174 as shown in FIG. 1, or may alternatively be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be any suitable sensor for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen for example when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some embodiments, each cylinder of engine 10 may be configured with one or more fuel injectors for providing fuel thereto. As a non-limiting example, cylinder 14 is shown including two fuel injectors 166 and 170. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 as a side injector, it may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from high pressure fuel system 172 including a fuel tank, fuel pumps, a fuel rail, and driver 168. Alternatively, fuel may be delivered by a single stage fuel pump at lower pressure, in which case the timing of the direct fuel injection may be more limited during the compression stroke than if a high pressure fuel system is used. Further, while not shown, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel in proportion to the pulse width of signal FPW-2 received from controller 12 via electronic driver 171. Fuel may be delivered to fuel injector 170 by fuel system 172.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions such as described herein below. The relative distribution of the total injected fuel among injectors 166 and 170 may be referred to as a first injection ratio. For example, injecting a larger amount of the fuel for a combustion event via (port) injector 170 may be an example of a higher first ratio of port to direct injection, while injecting a larger amount of the fuel for a combustion event via (direct) injector 166 may be a lower first ratio of port to direct injection. Note that these are merely examples of different injection ratios, and various other injection ratios may be used. Additionally, it should be appreciated that port injected fuel may be delivered during an open intake valve event, closed intake valve event (e.g., substantially before an intake stroke, such as during an exhaust stroke), as well as during both open and closed intake valve operation. Similarly, directly injected fuel may be delivered during an intake stroke, as well as partly during a previous exhaust stroke, during the intake stroke, and partly during the compression stroke, for example. Further, the direct injected fuel may be delivered as a single injection or multiple injections. These may include multiple injections during the compression stroke, multiple injections during the intake stroke, or a combination of some direct injections during the compression stroke and some during the intake stroke. When multiple direct injections are performed, the relative distribution of the total directed injected fuel between an intake stroke (direct) injection and a compression stroke (direct) injection may be referred to as a second injection ratio. For example, injecting a larger amount of the direct injected fuel for a combustion event during an intake stroke may be an example of a higher second ratio of intake stroke direct injection, while injecting a larger amount of the fuel for a combustion event during a compression stroke may be an example of a lower second ratio of intake stroke direct injection. Note that these are merely examples of different injection ratios, and various other injection ratios may be used.

As such, even for a single combustion event, injected fuel may be injected at different timings from a port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such each cylinder may similarly include its own set of intake/exhaust valves, fuel injector(s), spark plug, etc.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel system 172 may include one fuel tank or multiple fuel tanks. In embodiments where fuel system 172 includes multiple fuel tanks, the fuel tanks may hold fuel with the same fuel qualities or may hold fuel with different fuel qualities, such as different fuel compositions. These differences may include different alcohol content, different octane, different heat of vaporizations, different fuel blends, and/or combinations thereof etc. In one example, fuels with different alcohol contents could include gasoline, ethanol, methanol, or alcohol blends such as E85 (which is approximately 85% ethanol and 15% gasoline) or M85 (which is approximately 85% methanol and 15% gasoline). Other alcohol containing fuels could be a mixture of alcohol and water, a mixture of alcohol, water and gasoline etc. In some examples, fuel system 172 may include a fuel tank holding a liquid fuel, such as gasoline, and also include a fuel tank holding a gaseous fuel, such as CNG. Fuel injectors 166 and 170 may be configured to inject fuel from the same fuel tank, from different fuel tanks, from a plurality of the same fuel tanks, or from an overlapping set of fuel tanks.

Controller 12 is shown in FIG. 1 as a microcomputer, including microprocessor unit 106, input/output ports 108, an electronic storage medium for executable programs and calibration values shown as read only memory chip 110 in this particular example, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

Storage medium read-only memory 110 can be programmed with computer readable data representing instructions executable by processor 106 for performing the methods described below as well as other variants that are anticipated but not specifically listed. An example routine that may be performed by the controller is described at FIG. 3.

FIG. 2 shows a schematic diagram of a multi-cylinder engine in accordance with the present disclosure. As depicted in FIG. 1, internal combustion engine 10 includes cylinders 14 coupled to intake passage 144 and exhaust passage 148. Intake passage 144 may include throttle 162. Exhaust passage 148 may include emissions control device 178.

Cylinders 14 may be configured as part of cylinder head 201. In FIG. 2, cylinder head 201 is shown with 4 cylinders in an inline configuration. In some examples, cylinder head 201 may have more or fewer cylinders, for example six cylinders. In some examples, the cylinders may be arranged in a V configuration or other suitable configuration.

Cylinder head 201 is shown coupled to fuel system 172. Cylinder 14 is shown coupled to fuel injectors 166 and 170. Although only one cylinder is shown coupled to fuel injectors, it is to be understood that all cylinders 14 included in cylinder head 201 may also be coupled to one or more fuel injectors.

Fuel injector 166 is depicted as a direct fuel injector. Fuel injector 166 may be coupled to first fuel rail 205. Fuel rail 205 may include pressure sensor 213. Fuel rail 166 may be further coupled to first fuel line 220. Fuel line 220 may be further coupled to one or more fuel tanks, fuel pumps, pressure regulators, etc.

Fuel injector 170 is depicted as a port fuel injector. Fuel injector 170 may be coupled to second fuel rail 206. Fuel rail 206 may include pressure sensor 214. Fuel rail 206 may be further coupled to second fuel line 221. Fuel line 221 may be further coupled to one or more fuel tanks, fuel pumps, pressure regulators, etc.

Figure 3:
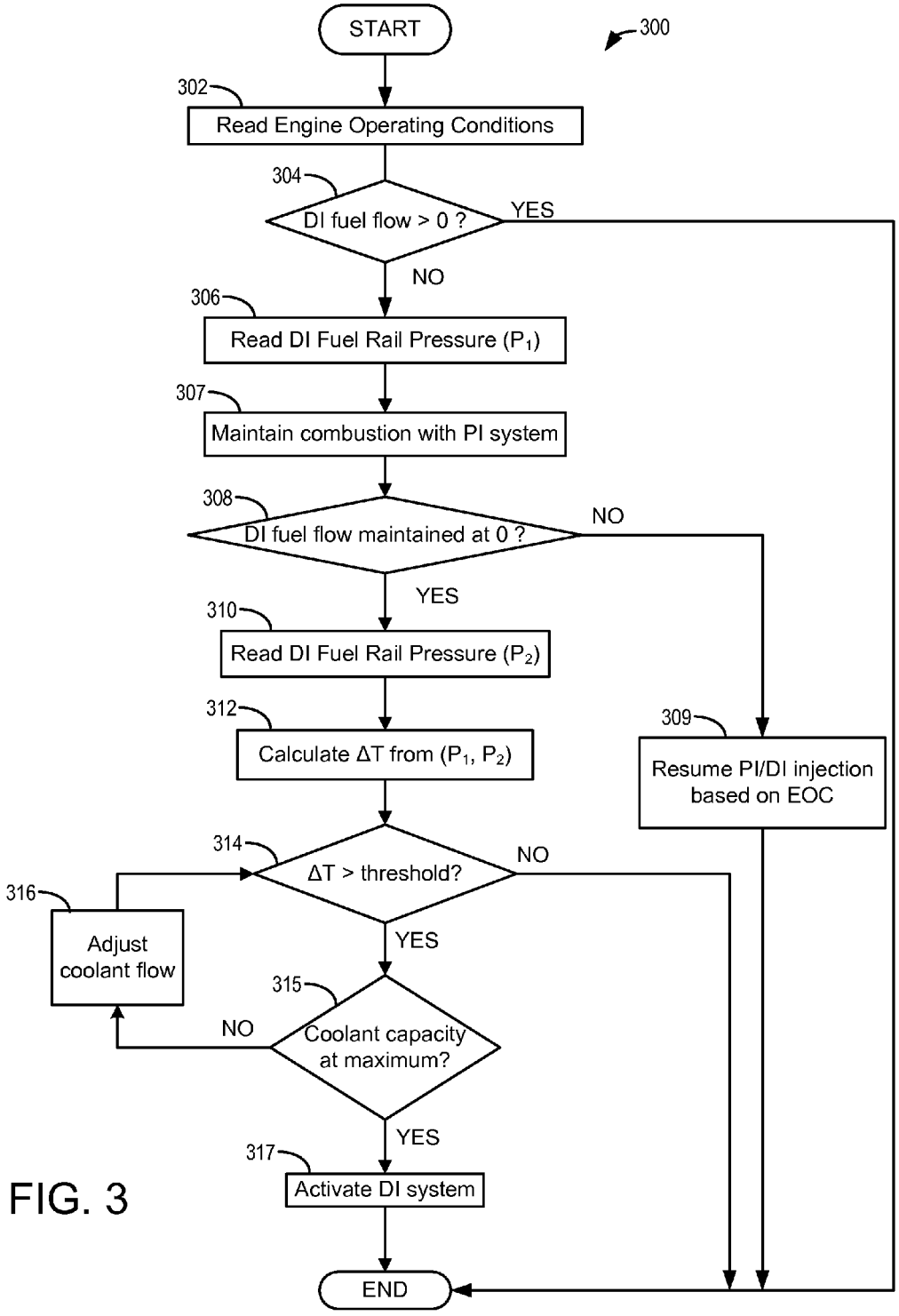
FIG. 3 depicts an example high level flow chart for operating an internal combustion engine including a port-fuel injection system and a direct-fuel injection system according to the present disclosure.
Figure 4:
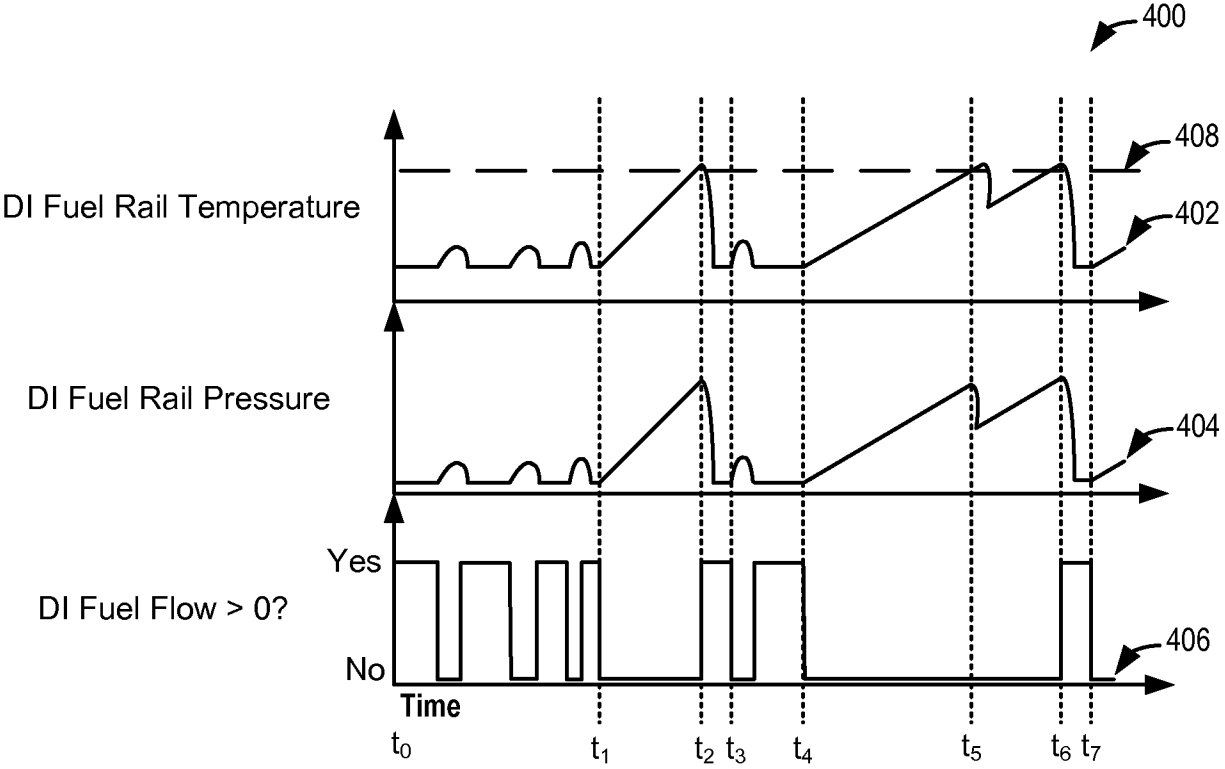
FIG. 4 is a graphical representation of an example timeline for vehicle operation and the operation of a direct-fuel injection system.

FIG. 3 shows an example method 300 for operating internal combustion engine 10 as depicted in FIGS. 1 and 2. Method 300 may be configured as computer instructions stored by a control system and implemented by a controller, for example controller 12 as shown in FIG. 1. At 302, method 300 may begin by reading engine operating conditions. Engine operating conditions may include engine speed, MAP pressure, MAF pressure, fuel levels, ambient pressure, and the operating status of the fuel system.

At 304, method 300 may include determining if the current net fuel flow through a direct fuel injector is greater than 0. Determining the current net fuel flow may include evaluating the status of each direct fuel injector 166, and/or the status of fuel flow through first fuel rail 205 as shown in FIG. 2. If there is net fuel flow through one or more direct fuel injectors, method 300 may end. If there is no net fuel flow through one or more direct fuel injectors 166, method 300 may proceed.

At 306, method 300 may include reading the pressure of a direct injection fuel rail. For example, controller 12 may assess the fuel pressure in fuel rail 205 by reading a first pressure with pressure sensor 213. Herein, this first pressure measurement will be referred to as $P_1$. In some embodiments, $P_1$ may be compared to a threshold pressure, and method 300 may proceed if $P_1$ is greater than the threshold pressure.

At 307, method 300 may include maintaining combustion with the port injection fuel system. The port injection fuel system may be used throughout the running duration of method 300 in order to maintain combustion during periods where the direct injection fuel system is not in use.

At 308, method 300 may include determining whether the direct injection fuel flow has been maintained at 0 without increasing above 0 in the time since pressure measurement $P_1$ was taken. In some embodiments, a controller may be configured to prevent direct injection fuel flow while method 300 is being implemented. If direct injection fuel flow has increased above 0, method 300 may proceed. At 309, method 300 may include resuming injection from the first and second fuel rails as a function of engine operating conditions. Both port injection and direct injection systems may be used, either alone or in tandem. Injection flow rates and injection timing may be the same for each cylinder, or determined individual for each cylinder based on engine operating conditions. In some embodiments, method 300 may end upon the initiation or detection of direct injection fuel flow.

At 310, if direct injection fuel flow has been maintained since pressure measurement $P_1$ was taken, method 300 may include reading the pressure of a direct injection fuel rail. For example, controller 12 may assess the fuel pressure in fuel rail 205 by reading a second pressure with pressure sensor 213. Herein, this second pressure measurement will be referred to as $P_2$.

In some embodiments, a controller may be configured to take the second pressure measurement after a predetermined amount of time after the first pressure measurement. In some embodiments, additional pressure measurements may be taken in addition to the first and second pressure measurements.

At 312, method 300 may include calculating a change in fuel temperature ($\Delta T$) as a function on the values of $P_1$ and $P_2$. For example, the calculation may include an equation: $(P_2-P_1)=(k_1/k_2)*(T_2-T_1)$, where $k_1$ is a coefficient of thermal expansion and $k_2$ is an isothermal compressibility coefficient. Coefficients $k_1$ and $k_2$ may have different values depending on the fuel qualities and fuel composition. In some embodiments, a value for $T_1$ may be determined immediately following the assessment of $P_1$, and a value for $T_2$ may be determined immediately following the assessment of $P_2$. In embodiments where the fuel rail is a rigid body, the fuel rail volume may be assumed to be constant for predetermined ranges of pressures and/or temperatures.

At 314, method 300 may include comparing $\Delta T$ to a predetermined threshold. If is less than the predetermined threshold, method 300 may end. In some examples, method 300 may return to 310 and may include taking one or more additional pressure readings. If is greater than the predetermined threshold, method 300 may proceed.

At 315, method 300 may include determining whether the capacity of a cooling system is at a maximum. In one example, method 300 may determine if it is possible to cool a fuel rail by increasing the flow of coolant or by lowering the temperature of coolant. If the cooling system is not at a maximum, method 300 may proceed to 316. At 316, method 300 may include adjusting a parameter of coolant flow. The parameter of coolant flow may be one or more of the flow rate of coolant, the temperature of coolant, the source of coolant, etc. When coolant flow has been adjusted, method 300 may return to 314 and determine if the temperature of the fuel rail has decreased to a value below a threshold value. If the fuel rail temperature has decreased to a value below the threshold value, method 300 may end. If the fuel rail temperature remains above the threshold value, method 300 may proceed to 315 and may include determining whether there the coolant capacity has reached a maximum value. If the coolant capacity has reached a maximum value, method 300 may proceed.

At 317, method 300 may include activating a direct fuel injector system. Activating a direct fuel injector system may include activating one of more direct fuel injectors, and may further include activating a fuel pump. The direct fuel injector system may be activated for a predetermined amount of time, or may be instructed to pump a predetermined amount of fuel through the direct fuel injectors.

Method 300 or other equivalent methods may be independently or as a subroutine for another engine operating method. Method 300 may be run repeatedly throughout the course of operating a vehicle, or may be run when specific operating conditions dictate.

FIG. 4 depicts a graphical representation of timeline 400 for engine operation and for the operation of a direct fuel injector. Timeline 400 includes graphical representation of fuel rail temperature, shown by line 402. Timeline 400 further includes graphical representation of fuel rail pressure, shown by line 404. Timeline 400 further includes graphical representation of the direct injection fuel flow, shown by line 406. Line 406 is depicted as representing two operating conditions, fuel flow greater than 0 and fuel flow equal to 0. Timeline 400 further depicts a temperature threshold 408. For example, threshold 408 may be the threshold discussed above with regards to 314 depicted in FIG. 3.

At time $t_0$, DI fuel flow rate is greater than 0. Between time $t_0$ and time $t_1$, the DI fuel flow rate alternates between being greater than 0 and being equal to 0. During periods where there DI fuel flow rate is equal to 0, DI fuel rail pressure may increase. Due to the rigid nature of the fuel rail, DI fuel rail temperature may increase accordingly with fuel rail pressure.

From time $t_1$ to time $t_2$, DI fuel flow is equal to 0. In other words, the direct injection system is not in use, and the engine may maintain combustion by operating the port fuel injection system. The DI fuel rail pressure and temperature rise from time $t_1$ to time $t_2$, where DI fuel rail temperature becomes greater than threshold 408. In response to the DI fuel rail temperature exceeding threshold 408, DI fuel flow is commanded to be greater than 0. Operation of the direct injection system continues from time $t_2$ to time $t_3$, and the increase in fuel flow through the direct injector is sufficient to reduce the temperature and pressure of the DI fuel rail such that the temperature of the DI fuel rail drops below threshold 408.

From time $t_4$ to time $t_5$, DI fuel flow is equal to 0. The DI fuel rail pressure and temperature rise from time $t_4$ to time $t_5$, where DI fuel rail temperature becomes greater than threshold 408. At time $t_5$, the flow rate of coolant to the fuel rail may be increased, as discussed above and with regards to FIG. 3. The increased coolant flow may result in the reduction of the temperature and pressure of the DI fuel rail such that the temperature of the DI fuel rail drops below threshold 408.

From time $t_5$ to time $t_6$, DI fuel flow remains equal to 0. The DI fuel rail pressure and temperature rise from time $t_5$ to time $t_6$, where DI fuel rail temperature becomes greater than threshold 408. At time $t_6$, a controller may determine that the coolant system is at maximum capacity. As such, DI fuel flow is commanded to be greater than 0. Operation of the direct injection system continues from time $t_6$ to time $t_7$, and the increase in fuel flow through the direct injector is sufficient to reduce the temperature and pressure of the DI fuel rail such that the temperature of the DI fuel rail drops below threshold 408.

In some examples, the problems described above may be addressed by a method of operating an engine fuel system, comprising: during a first condition, measuring a first pressure of a first fuel rail coupled to a direct fuel injector at a first point in time and measuring a second pressure of the first fuel rail at a second point in time following the first point in time, determining a change in fuel temperature as a function of the first and second pressures, and enabling fuel flow through the direct fuel injector system if the change in fuel temperature is greater than a first threshold. In some examples, the first condition may include a bulk fuel flow through the direct fuel injector being substantially equal to zero, and enabling fuel flow through the direct fuel injector system may include operating a first fuel pump and activating a direct fuel injector. In some examples, a port fuel injection system may be in use when the direct fuel system is not in use, and the port fuel injector system may be coupled to a second fuel rail and second fuel pump, where the first fuel pump may be a higher pressure fuel pump 173 and the second fuel pump may be a lower pressure fuel pump 175. The port fuel injector system may be coupled to a first fuel tank and the direct fuel injector system may be coupled to a second fuel tank. In some examples, the first fuel tank may contain a fuel with a different composition than a fuel contained in the second fuel tank.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

operating an engine cylinder with fuel from a first port injector and not a second direct injector; and activating the second direct injector in response to a rail pressure increase of a fuel rail, the fuel rail coupled to the second injector.

2. The method of claim 1, wherein the second injector is activated in response to rail pressure increasing above a threshold, the rail pressure increase corresponding to a temperature increase, the threshold corresponding to a maximum temperature threshold.

3. The method of claim 2, further comprising deactivating the second injector when the rail pressure decreases below the threshold.

4. The method of claim 1, wherein fuel is trapped in the fuel rail while monitoring the pressure increase, the method further comprising activating a fuel pump coupled to the fuel rail in response to the rail pressure increase.

5. The method of claim 4, further comprising adjusting injection of the first injector responsive to activation of the second injector.

6. The method of claim 1, wherein the second injector activation is further based on a fuel rail rigidity.

7. The method of claim 1, wherein the second injector activation is further based on a fuel coefficient of thermal expansion.

8. The method of claim 1, further comprising adjusting a parameter of a cooling system coupled to the fuel rail in response to the rail pressure increase of the fuel rail.

9. The method of claim 8, where the parameter is a flow rate of a coolant.

10. The method of claim 8, where the parameter is a temperature of a coolant.

11. A system for an internal combustion engine, comprising:

a boosting device coupled to a group of cylinders;

a group of direct fuel injectors in communication with the group of cylinders;

a group of port fuel injectors in communication with the group of cylinders;

a first fuel rail in communication with the group of direct injectors;

a higher-pressure fuel pump in communication with the first fuel rail; and a control system configured with instructions for: increasing a flow of fuel through the first fuel rail when a temperature change in a fuel included in the first fuel rail exceeds a threshold, the temperature change based on a rail pressure change.

12. The system of claim 11, where a first condition includes a bulk fuel flow through the group of direct fuel injectors being substantially equal to zero.

13. The system of claim 12, further comprising: a second fuel rail in communication with the group of port fuel injectors; and a lower-pressure fuel pump in communication with the second fuel rail.

14. The system of claim 13, where the group of port fuel injectors is in use during the rail pressure change.

15. The system of claim 11, where increasing the flow of fuel through the first fuel rail includes activating the higher-pressure fuel pump, wherein the boosting device is a turbocharger.

16. The system of claim 11, where allowing fuel flow through a direct fuel injector system includes activating the group of direct fuel injectors.

17. The system of claim 11, where the temperature change is determined as a function of a change in pressure over conditions with the group of direct fuel injectors deactivated, the increasing of fuel flow including reactivating at least one direct fuel injector from the group.

18. A method, comprising:

operating an engine cylinder with fuel from a first port injector and not a second direct injector; and activating a fuel pump coupled to the second direct injector in response to a rail pressure increase of a fuel rail, the fuel rail coupled between the second direct injector and the pump.

19. The method of claim 18, wherein the second injector is activated in response to rail pressure increasing above a threshold, the rail pressure increase corresponding to a temperature increase, the threshold corresponding to a maximum temperature threshold.

* * * * *